US007340920B2

(12) United States Patent
Zimmermann

(10) Patent No.: US 7,340,920 B2
(45) Date of Patent: Mar. 11, 2008

(54) CIRCUIT WITH TWO-STEP CAPILLARY TUBE THROTTLING AND RECEIVER

(76) Inventor: Lars Christian Wulff Zimmermann, Hoejgaardsparken 18, Trige (DK) DK-8380

( * ) Notice: Subject to any disclaimer, the term of this patent is extended or adjusted under 35 U.S.C. 154(b) by 18 days.

(21) Appl. No.: 10/595,164

(22) PCT Filed: Sep. 16, 2004

(86) PCT No.: PCT/DK2004/000611

§ 371 (c)(1),
(2), (4) Date: Mar. 13, 2006

(87) PCT Pub. No.: WO2005/028971

PCT Pub. Date: Mar. 31, 2005

(65) Prior Publication Data

US 2007/0006611 A1 Jan. 11, 2007

(30) Foreign Application Priority Data

Sep. 22, 2003 (DK) ..... 2003 01374

(51) Int. Cl.
*F25B 41/00* (2006.01)

(52) U.S. Cl. ..... 62/513; 62/511

(58) Field of Classification Search ..... 62/513, 62/498, 509, 511
See application file for complete search history.

(56) References Cited

U.S. PATENT DOCUMENTS 2,137,260 A * 11/1938 Boles ..... 62/503
2,520,045 A 8/1950 McGrath
2,871,680 A 2/1959 Zearfoss, Jr.

* cited by examiner

*Primary Examiner*—Melvin Jones
(74) *Attorney, Agent, or Firm*—Brooks Kushman P.C.

(57) ABSTRACT

A Thermostatic Flow Controller composed of two capillary tubes and a tube form receiver, placed in thermal contact with the suction line. It makes a robust, hermitic closed device, without any moveable parts, no need for adjustment or service and therefor suited for inaccessible placement—for instance encapsulated in isolation foam. The flow of refrigerant to the evaporator is controlled by the pressure in the receiver—and the pressure in the receiver is controlled by the need for refrigerant in the evaporator. This balance ensures that the evaporator is flooded, and thereby exploited 100%—for all kind of charges. The invention is suited for small household freezers and refrigerators. For a small extra cost, it replaces the traditional capillary tube, and makes these devices working optimal on both cold and warm locations, and makes the manufacturing more easy because the amount of refrigerant is no longer critical as it is for traditional capillary tubes.

2 Claims, 1 Drawing Sheet

CIRCUIT WITH TWO-STEP CAPILLARY TUBE THROTTLING AND RECEIVER

This invention relates to refrigeration circuits composed of compressor, condenser, evaporator, two capillary tubes and a receiver with heat exchanger. The refrigerant is throttled, first from the condenser to the receiver, where the heat excess is removed via the heat exchanger, and then from the receiver to the evaporator. The pressure drop, from condenser to evaporator, is divided between the two capillary tubes, and the pressure in the receiver is floating between condenser and evaporator—controlled by the heat exchanger.

The technique with two-step capillary tube throttling, separated by a heat exchanger, is know from U.S. Pat. No. 2,137,260. The benefit of this construction is, that it restrains refrigerant in gaseous form, at the condenser outlet, but the construction do not have any controlling effect on the flow of refrigerant—the flow of refrigerant is controlled by a suction accumulator placed at the evaporator outlet.

DK174179 also uses a two-step capillary tube throttling, separated by a heat exchanger, but differ from U.S. Pat. No. 2,137,260 in two ways: the receiver is placed in connection with the heat exchanger—and the refrigerant is sub-cooled before the last throttling to the evaporator. This construction has in addition a controlling effect on the flow of refrigerant from the receiver to the evaporator.

The first throttling step, from condenser to receiver, adds heat to the receiver, which increases the temperature and thereby the pressure. The suction gas removes heat from the receiver—and thereby decreasing temperature and pressure. The pressure and the temperature in the receiver is forced against equilibrium between heat added and heat removed, and at the point of equilibrium, relation R1 becomes valid:

$$CP_{liquid}*(T_{condenser}-T_{evaporator})=CP_{gas}*(T_{receiver}-T_{evaporator})+RT*Y \quad (R1)$$

where

CP is the heat capacity of the refrigerant. Index for gas or liquid form.

RT is the heat of evaporation

Y is the rate of refrigerant in liquid form, at the outlet from the evaporator.

An essential purpose of the circuit is to keep the evaporator flooded, which implies that Y is positive. This requirement is substituted into R1 and makes R2:

$$R1\hat{}(Y>0)\Rightarrow CP_{liquid}*(T_{condensor}-T_{receiver})>CP_{gas}*(T_{receiver}-T_{evaporator})\Leftrightarrow(T_{receiver}-T_{evaporator})<(CP_{liquid}/CP_{gas})*(T_{condensor}-T_{receiver}) \quad (R2)$$

Relation R2 sets an upper limit on how much of the total pressure drop there can be allowed for the second throttling, compared to the first throttling. Because the pressure drop, at the second throttling, also establish the temperature difference across the heat exchanger, it is essentially that this pressure drop is as big as possible—to make the heat area as small as possible.

Because the temperature in the receiver is higher that the temperature in the evaporator, the refrigerant will boil in the capillary tube, if it is throttled directly from the receiver to the evaporator. In DK174179, this problem is solved with a SelfCoolingValve, composed of a capillary tube with heat transfer between the refrigerant entering and leaving the capillary tube. In this way, heat is passed round the capillary tube and transferred directly to the evaporator. The SelfCoolingValve is universal, because it is not depending on any form of external cooling—but it does require an extra, private heat exchanger.

Small freezers and refrigerators are produced in large numbers and sold at very low prices, and for this marked the regulator, described in DK174179, is to complicated and to expensive. The invention is more simple, easier to assemble and much cheaper to produce. The invention is composed of a pipe formed receiver, extended with a capillary tube in both ends. Refrigerant is throttled in two step: first from the condenser to the top of the receiver and then from the bottom of the receiver to the evaporator. The suction line is placed in thermal contact with the pipe formed receiver—such oriented that the suction gas pass from the bottom towards the top, forming a heat exchanger with counter current flow. The liquid in the bottom of the receiver will be sub-cooled close to the evaporator temperature and the suction gas will be super-heated close to the receiver temperature. At equilibrium, between added and removed heat, relation R3 is valid:

$$CP_{liquid}*(T_{condensor}-T_{evaporator})=CP_{gas}*(T_{receiver}-T_{evaporator})+RT*Y \quad (R3)$$

A main purpose of the circuit is to keep the evaporator flooded, which implies that Y is positive. This requirement is substituted into R3 and makes R4:

$$R3\hat{}(Y>0)\Rightarrow CP_{liquid}*(T_{condensor}-T_{receiver})>CP_{gas}*(T_{receiver}-T_{evaporator})\Leftrightarrow(T_{receiver}-T_{evaporator})<(CP_{liquid}/CP_{gas})*(T_{condensor}-T_{evaporator}) \quad (R4)$$

The heat capacity of liquid is always higher than the heat capacity of gas. This relation is substituted into R4 making R5:

$$R4\hat{}(CP_{liquid}/CP_{gas})<1\Rightarrow(T_{receiver}-T_{evaporator})<(T_{condensor}-T_{evaporator})\Leftrightarrow T_{receiver}>T_{condensor} \quad (R5)$$

Relation R5 is always true—and the evaporator will be full flooded, without any restriction on the temperature in the receiver, like relation R2—which is valid for DK174179. That means that the temperature in the receiver can be chosen higher and the heat area smaller.

If the liquid is sub-cooled in the bottom of the receiver, it can be throttled directly to the evaporator without any further cooling—but it is important to fulfill the requirement of sub-cooled liquid. The requirement is fulfilled when the evaporator is flooded—because then the evaporator is "bleeding" with liquid refrigerant. Relation R5 ensures that the evaporator is flooded at equilibrium—so the only thing left, is to make sure that the evaporator is flooded before equilibrium. If the evaporator inlet is placed at the evaporator bottom, then all the refrigerant will be accumulated in the evaporator during standstill—and consequently the evaporator will be flooded at start up.

1: compressor, 2: condenser, 3: liquid line, 4: evaporator, 5: suction line, 8: capillary tube, 9: receiver, 10: capillary tube, 11: thermal contact between receiver and suction line, 12: thermal contact between capillary tube and suction line.

Figure 1:
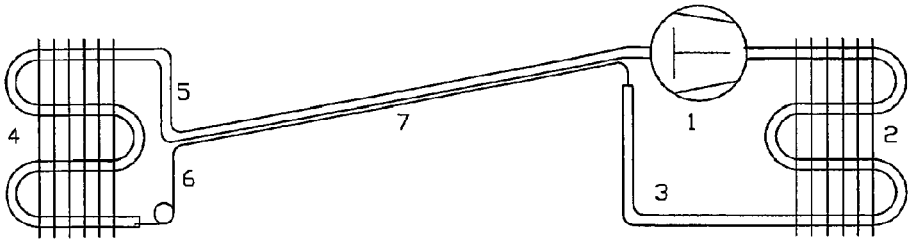
FIG. 1 shows, roughly, the circuit normally used for small freezers and refrigerators. 1: compressor, 2: condenser, 3: liquid line, 4: evaporator, 5:suction line, 6: capillary tube, 7: thermal contact between capillary tube and suction line.

Manufactures of small household freezers and refrigerators normally use a capillary tube with thermal contact to the suction line, as throttling device, as sketched in FIG. 1. This construction results in superheated suction gas, with yields two advantages: the COP (Coefficient Of Performances) increases (for most refrigerants) and the warm suction gas prevents condensed water from the suction line—which otherwise might cause damage behind freezers and refrigerators. With the invention the same advantages can be obtained by placing the first capillary tube in thermal contact with the suction line, as show in FIG. 2 at mark (12).

Implementation of the Invention:

The invention is composed of 4 parts, a suction line, a pipe formed receiver and 2 pieces of capillary tubes. As an example, suitable dimensions are calculated for a 100 Watt freezer with Danfoss compressor NLY9KK. The temperature in the receiver had been chosen to +10 C.

From NLY9KK data sheet:

Refrigerant: R600A

Cooling effect at 30 C/−30 C (condenser/evaporator) 100 W

Mass flow: 1.37 kg/h=0.34 g/s

Heat is transferred to the suction line at three locations:

1. From capillary tube:

$$Q_{capillary}=\text{Flow}*CP_{gas}*20\text{K}=0.34\ \text{g/s}*1.7\ \text{J/g/K}*20\text{K}=12\ \text{W}$$

2. From condensing of gas in top of the receiver:

$$Q_{gas}=\text{Flow}\times CP_{liquid}\times 20K-Q_{capillary}$$

$$=0.34g/s*2.3J/g/K*20K-12W=16W-12W=4W$$

3. From sub-cooling of liquid in the bottom of the receiver $$Q_{liquid}=\text{Flow}*CP_{liquid}*40\text{K}=0.34\ \text{g/s}*2.3\ \text{J/g/K}*40\text{K}=31\ \text{W}$$

A heat exchanger is capable to transfer this quantity of heat:

$$Q=U*A*LMTD \quad \text{(R6)}$$

where

U: heat transfer coefficient

A: heat transfer area

LMTD: Logarithmic Mean Temperature Difference

For a tube heat exchanger lice this:

$$U=0.1\ \text{W/cm}^2/\text{K}$$

$$LMTD=(dT_1-dT_2)/LN(dT_1/dT_2)$$

where $dT_1$ and $dT_2$ are the temperature difference at the heat exchanger inlet and outlet. For simplicity the temperature difference, at the heat exchanger outlet, is here chosen to:

$$dT_2=1\text{K}$$

The bottle-neck, for the heat transfer, is the inside area of the suction line, and the minimum of this area is calculated from a rearrangement of R6 into R7;

$$Q=U*A*LMTD\Rightarrow A=Q/(U*LMTD) \quad \text{(R7)}$$

By substitution into R7, the minimum thermal contact areas are calculated for the three locations at the suction line:

1. Along the capillary tube, se FIG. 2 mark 12:

$$dT_1=[20\text{K}*(1-CP_{gas}/CP_{liquid})]=5.5\text{K}\hat{}(dT_2=1\text{K})\Rightarrow LMTD=(dT_1-dT_2)/LN(dT_1/dT_2)=4.5\text{K}/LN(5.5)=2.6\text{K}$$

$$A_{capillary}>=Q_{capillary}/(U*LMTD)=12\text{W}/(0.1\text{W/cm}^2/\text{K}\times 2.6\text{K})=46\ \text{cm}^2$$

The length of the capillary tube heat exchanger has to be at least:

$$L_{capillary}>46\ \text{cm}^2/1.5\ \text{cm}=31\ \text{cm}$$

2. Condensing at the receiver top:

$$(dT_2=40\text{K})\hat{}(dT2=1\text{K})\Rightarrow LMTD=(dT_1-dT_2)/LN(dT_1/dT_2)=39/LN(40)=10.6\text{K}$$

$$A_{condensing}>=Q_{condensing}/(U*LMTD)=4\ \text{W}/(0.1\ \text{W/cm}^2/\text{K}*10.6\text{K})=4\ \text{cm}^2$$

From that follows, that the suction line contact with receiver top must be at least:

$$L_{Receiver\ top}>4\ \text{cm}^2/1.5\ \text{cm}=3\ \text{cm}$$

3. For sub-cooling at the receiver bottom:

$$(dT_1=40\text{K})\hat{}(dT2=1\text{K})\Rightarrow LMTD=(dT_1-dT_2)/LN(dT_1/dT_2)=39/LN(40)=10.6\text{K}$$

$$A_{condensing}>=Q_{condensing}/(U*LMTD)=31\ \text{W}/(0.1\ \text{W/cm}^2/\text{K}*11\text{K})=28\ \text{cm}^2$$

and from that, the suction line contact with receiver bottom must be at least:

$$L_{Receiver\ bottom}>28\ \text{cm}^2/(150\ \text{cm}^2/\text{m})=19\ \text{cm}$$

The calculations show:

1. the thermal contact between capillary tube and suction line must be at least 31 cm.
2. The contact between receiver and suction line must extent at least (3 cm+19 cm=) 22 cm.

By choosing the receiver 50 cm long, the level of refrigerant can vary by 28 cm—and still comply with the requirement: that at least 22 cm is free for heat transfer. By choosing the receiver diameter 22 mm, the volume of refrigerant can vary with 75 ml, corresponding to 45 g. The part list becomes, with reference to FIG. 2:

Suction line: 6 mm×120 cm copper tube (5,11,12)

Receiver: 22 mm×50 cm (9)

First throttling: 0.7 mm×90 cm capillary tube, with at least 31 cm thermal contact to suction line (12)

Second throttling: 0.7 mm×90 cm capillary tube (10)

Figure 2:
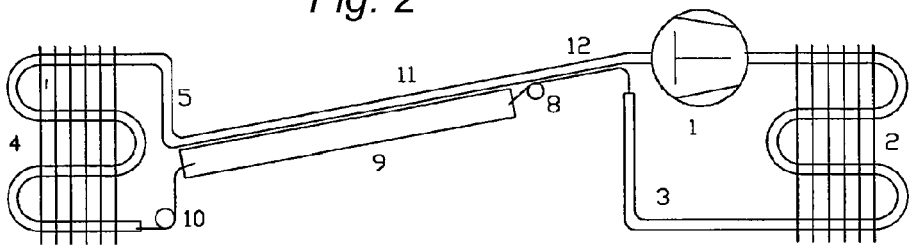
FIG. 2 shows, roughly, the invention, which only differ from FIG. 1, by the tube formed receiver—splitting the capillary tube in two parts.

The invention provides an effective and cheap regulator as an alternative to the traditional capillary tube throttling for small household freezers and refrigerators. The regulator makes freezers and refrigerators working more effective and more suited for varying temperature. It is easy for manufactures to adapt the invention—a look at FIGS. 1 and 2 shows, that the only difference is a small receiver, placed at the middle of the capillary tube.

The invention claimed is:

1. A closed refrigeration circuit comprising:

a compressor having an inlet and an outlet;

a condenser having an inlet coupled to the compressor outlet and an outlet;

a receiver having an inlet in a top region in fluid communication with the condenser outlet and an outlet in a bottom region located at a lower elevation than the receiver inlet;

an evaporator having an inlet in fluid communication with the receiver outlet and an outlet;

a suction line having an inlet coupled to the evaporator outlet and an outlet coupled to the compressor inlet;

a first capillary throttling element oriented between condenser and receiver; and a second capillary throttling element oriented between receiver and evaporator;

wherein the suction line is orientated adjacent to and in thermal contact with the receiver so that gaseous refrigerant in the suction line pass from adjacent the receiver bottom towards receiver top, while the refrigerant in the receiver flows from the receiver top towards the receiver bottom.

2. The closed refrigeration circuit of claim 1 wherein the first capillary throttling element is in thermal contact with the suction line.

* * * * *